US009420670B1

(12) United States Patent
Xiong et al.

(10) Patent No.: US 9,420,670 B1
(45) Date of Patent: Aug. 16, 2016

(54) CONTROLLER AND RECEIVER FOR A POWER LINE COMMUNICATION SYSTEM

(71) Applicant: Universal Lighting Technologies, Inc., Madison, AL (US)

(72) Inventors: Wei Xiong, Madison, AL (US); Travis L. Berry, Madison, AL (US); John Cavacuiti, Burnaby (CA); Rob Mahaffey, Burnay (CA)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 14/930,175

(22) Filed: Nov. 2, 2015

Related U.S. Application Data

(60) Provisional application No. 62/074,731, filed on Nov. 4, 2014.

(51) Int. Cl.
*H05B 37/02* (2006.01)
*H05B 33/08* (2006.01)

(52) U.S. Cl.
CPC ..... *H05B 37/0263* (2013.01); *H05B 33/0809* (2013.01); *H05B 33/0845* (2013.01)

(58) Field of Classification Search
CPC . H05B 37/02; H05B 33/0815; H05B 33/0845
USPC ..... 315/291
See application file for complete search history.

(56) References Cited

U.S. PATENT DOCUMENTS 3,488,517 A 1/1970 Cowan et al.
3,525,078 A 8/1970 Baggott
3,594,584 A 7/1971 Woods
3,714,451 A 1/1973 Whitney et al.
3,721,830 A 3/1973 Oishi et al.
3,818,466 A 6/1974 Honda
4,254,403 A 3/1981 Perez-Cavero et al.
4,348,582 A 9/1982 Budek
4,400,688 A 8/1983 Johnston et al.
4,408,185 A 10/1983 Rasmussen
4,523,128 A 6/1985 Stamm et al.
4,680,508 A 7/1987 Rucki
4,704,563 A 11/1987 Hussey
5,043,635 A 8/1991 Talbott et al.
5,068,576 A 11/1991 Hu et al.
5,107,184 A 4/1992 Hu et al.
5,227,762 A 7/1993 Guidette et al.
5,471,119 A 11/1995 Ranganath et al.
(Continued)

*Primary Examiner* — Don Le

(74) *Attorney, Agent, or Firm* — Patterson Intellectual Property Law, P.C.; Mark J. Patterson; Gary L. Montle

(57) ABSTRACT

A power line communication system communicates dimming levels to a lighting circuit over AC power lines. A power line controller generates control signals which are inserted on the AC power signal to the lighting circuit. A first series resonant circuit is coupled across the AC lines to bypass high frequency components from the control signals. A power line receiver receives the AC power signal and extracts the control signal to generate dimming level signals corresponding with the desired dimming level. To extract the control signal out of the AC power signal, the power line receiver has a resonant circuit connected in parallel with the AC power line and tuned to transmit the ballast control signal and to filter out the AC power signal. A dimming level sensing circuit then senses the signal pattern on the control signal and generates a dimming level signal corresponding to the desired dimming level.

20 Claims, 6 Drawing Sheets

(56) References Cited

U.S. PATENT DOCUMENTS

| | | | | |
|---|---|---|---|---|
| 5,475,360 | A | 12/1995 | Guidette et al. | |
| 5,691,605 | A | 11/1997 | Xia et al. | |
| 5,691,691 | A | 11/1997 | Merwin et al. | |
| 6,218,787 | B1 | 4/2001 | Murcko et al. | |
| 6,225,759 | B1 | 5/2001 | Bogdan et al. | |
| 6,388,399 | B1 | 5/2002 | Eckel et al. | |
| 6,608,552 | B1 | 8/2003 | Fogel et al. | |
| 6,734,784 | B1 | 5/2004 | Lester | |
| 6,842,668 | B2 | 1/2005 | Carson et al. | |
| 7,154,229 | B2 | 12/2006 | Alexandrov et al. | |
| 7,180,250 | B1 * | 2/2007 | Gannon | H05B 39/044 315/276 |
| 7,391,168 | B1 | 6/2008 | Dernovsek et al. | |
| 7,619,539 | B2 | 11/2009 | Veskovic et al. | |
| 7,843,145 | B2 | 11/2010 | McKenzie et al. | |
| 8,760,082 | B2 * | 6/2014 | Yang | H05B 33/0815 315/192 |
| 2009/0108765 | A1 * | 4/2009 | Weightman | H05B 39/08 315/224 |
| 2011/0074304 | A1 * | 3/2011 | Honsberg-Riedl | H05B 33/0815 315/250 |
| 2011/0122165 | A1 * | 5/2011 | Sengoku | G09G 3/342 345/690 |
| 2014/0009082 | A1 * | 1/2014 | King | H05B 37/02 315/247 |
| 2014/0055055 | A1 * | 2/2014 | Melanson | H02M 3/335 315/228 |

* cited by examiner

CONTROLLER AND RECEIVER FOR A POWER LINE COMMUNICATION SYSTEM

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of U.S. Provisional Patent Application No. 62/074,731, filed Nov. 4, 2014, and which is hereby incorporated by reference.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to dimming control for lighting devices. More particularly, the present invention relates to a power line communication system for transmitting a dimming level to an electronic ballast or LED driver that regulates output current to an associated lighting device.

Power line communication systems are known in the art for communicating a dimming level to a lighting circuit such as an electronic ballast or LED driver over an AC power line. The dimming level determines the power output of the lighting circuit and therefore the lighting intensity of an associated lighting device such as a fluorescent lamp or LED array. A power line controller is operable to generate a dimming control signal and to insert that signal on the AC power signal being transmitted over the AC power line to a power line receiver associated with the lighting circuit. The power line receiver then extracts this information from the AC power signal and generates a dimming level signal corresponding to the desired dimming level, which then causes the lighting circuit to generate an output signal to the lighting device in accordance with the desired dimming level. In this manner, a user can control the power consumed by the lighting device and accordingly a lighting intensity.

Several prior art solutions exist for transmitting information to a lighting circuit such as an electronic ballast over AC power lines, including using power line modems, high frequency injection codes and line voltage modulation codes. Unfortunately, the equipment required to insert information into the AC power signal and then extract the information at the lighting circuit is expensive. Furthermore, these systems are particularly sensitive to noise and require control signals with high signal levels to communicate the desired dimming level over the power line. This is particularly true if the system is communicating with several lighting circuits at once.

What is needed, then, is a power line communication system that inserts information on the AC power signal that is more cost efficient and less sensitive to noise.

BRIEF SUMMARY OF THE INVENTION

A power line communication system as disclosed herein communicates a desired dimming level to a lighting circuit such as an electronic ballast or an LED driver over an AC power line. The system has a power line controller and a power line receiver connected to the AC power line. The power line controller is configured to generate a control signal and to insert that signal on the AC power signal being transmitted over the AC power line. The power line receiver receives the AC power signal and extracts the control signal from the AC power signal to generate the dimming level signal corresponding with the desired dimming level. The power line receiver may be integral to the lighting circuit or may be a separate apparatus that communicates with the lighting circuit.

An embodiment of a power line controller as disclosed herein has a signal pattern circuit for producing a control signal corresponding to a predetermined communication code for communicating dimming levels to lighting circuits. This communication code is simply a method of representing dimming levels for a lighting circuit so that the power line receiver can translate this information into the appropriate dimming level signal. The desired dimming level being communicated by the power line controller is embedded in the control signal as a signal pattern that is associated with the desired dimming level.

To insert the control signal on the AC power signal, the power line controller has a transformer coupled to the signal pattern circuit. The secondary winding of this transformer is connected in series with the AC power line to insert the control signal on the AC power signal.

A high frequency series resonant filter is coupled across the AC main input lines. A resonant frequency of the filter is tuned to the frequency of the control signal wherein an impedance of the filter at the control signal frequency is close to zero, thereby effectively preventing the control signal from feeding back to the AC main lines or other loads that are coupled to the same AC main lines.

This AC power signal is then transmitted to the lighting circuit(s). To extract the control signal out of the AC power signal, a power line receiver has a resonant circuit connected in parallel with the AC power line. The resonant circuit should be tuned to transmit the control signal and to filter out the AC power signal. A dimming level sensing circuit then senses the signal pattern on the control signal and generates a dimming level signal corresponding to the desired dimming level.

DETAILED DESCRIPTION OF THE INVENTION

Figure 1:
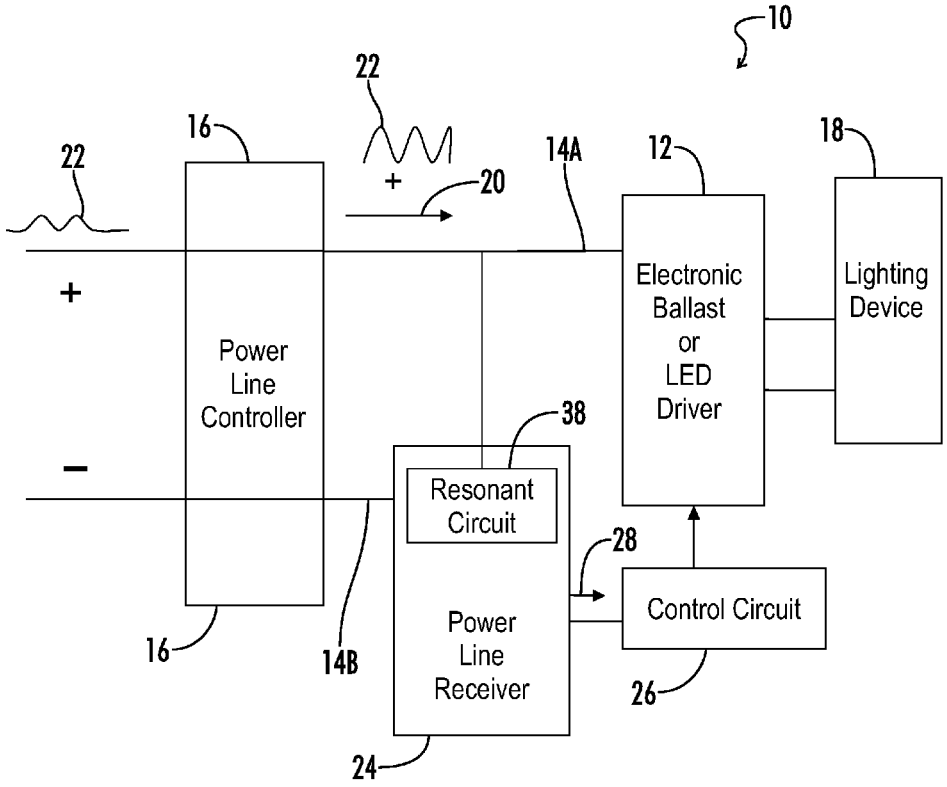
FIG. 1 is a block diagram of an embodiment of the power line communication system as disclosed herein.

Referring generally to FIGS. 1-4A, various exemplary embodiments of an invention may now be described in detail. Where the various figures may describe embodiments sharing various common elements and features with other embodiments, similar elements and features are given the same reference numerals and redundant description thereof may be omitted below.

Referring now to FIG. 1, an embodiment of a power line communication system 10 communicates a desired dimming level to one or more lighting circuits 12 over AC power lines 14A, 14B. Power line controller 16 controls the lighting circuit 12 so that the lighting circuit 12 dims an associated lighting device 18 in accordance with a desired dimming level. A "lighting circuit" in accordance with the present invention may, unless otherwise stated or as required for the purposes of a specific application, be understood to encompass either or both of an electronic ballast for regulating output AC power to a lamp or an LED driver for regulating output DC power to an LED array.

To control the lighting circuit 12, the power line controller 16 inserts a control signal 20 on an AC power signal 22 transmitted over the AC power lines 14A, 14B. Power line receiver 24 receives the AC power signal 22 and extracts the control signal 20. Power line receiver 24 then generates a dimming level signal 28 corresponding to the desired dimming level. This dimming level signal 28 may be received by a control circuit 26 that controls the power output from the lighting circuit 12. Using the example of an electronic ballast for the lighting circuit, the control circuit 26 may then adjust the operating frequency of one or more switching elements in a ballast inverter circuit so that the electronic ballast 12 operates at the desired ballast dimming level.

The power line communication system 10 may operate by utilizing analog and digital communication codes for communicating dimming levels to lighting circuits. These codes generally associate a particular signal pattern with a particular dimming level. For example, if a digital communication code is used, the signal pattern will represent a series of "ones" and "zeros". The power line receiver 24 may then translate the signal pattern into a digital word corresponding to a particular dimming level to produce the appropriate dimming level signal 28.

Figure 1A:
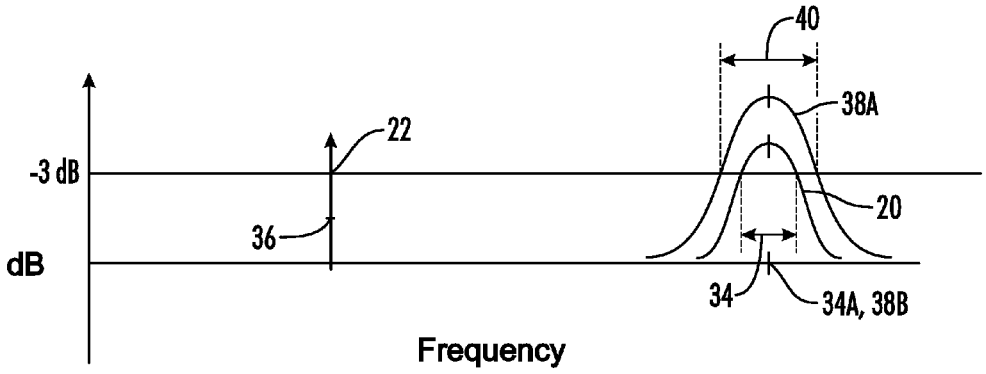
FIG. 1A is a frequency domain graph showing a frequency bandwidth of one embodiment of the control signal, a frequency bandwidth of one embodiment of the AC power signal, and a bandwidth of transmission for one embodiment of the resonant circuit.

Referring now to an embodiment as represented in FIGS. 1 and 1A, the control signal 20 may be generated by the power line controller 16 to be within a particular frequency bandwidth 34. The frequency bandwidth 34 of the control signal 20 should be outside a frequency bandwidth 36 of the AC power signal 22. Theoretically, the AC power signal 22 may be represented as a Kronecker delta in the frequency domain and therefore has an infinitely thin frequency bandwidth 36. In practice, however, the frequency bandwidth 36 of the AC power signal 22 will have a measureable bandwidth. FIG. 1A illustrates that the center frequency 34A of the control signal 20 is typically 15 kHz or higher. The power line receiver 24 may have a resonant circuit 38 with a response curve 38A that has a bandwidth 40 outside the bandwidth 36 of the AC power signal 22. The bandwidth 34 of the control signal 20 however may typically be within the bandwidth 40 of the response curve 38A of the resonant circuit 38. This permits the power line receiver 24 to receive the control signal 20 and to filter out the AC power signal 22.

Bandwidth is generally defined as a range of frequencies in which the frequency signal components of a signal or the response curve of the circuit are above an amplitude threshold. The standard amplitude threshold for defining bandwidth is typically half of the maximum value of the signal or −3 decibels. However, the meaning of bandwidth for this application is not limited to half the maximum value or −3 decibel threshold. The bandwidth of interest should correspond to the particular embodiment implemented. For example, if the control signal 20 is particularly flat in the frequency domain so to include a significant amount of signal components away from a center frequency, the bandwidth 34 of the control signal 20 may be defined by a higher amplitude threshold to compensate for signal components which may be above or near to the −3 decibel threshold. Conversely, if the control signal is particularly narrow, it may be advantageous to lower the amplitude threshold that defines the bandwidth 34 of the control signal 20 which would require a less sensitive resonant circuit 38.

Referring again to the embodiment of FIG. 1 and FIG. 1A, the resonant circuit 38 is connected across the AC power lines 14A, 14B. By connecting the resonant circuit 38 in parallel with the AC power lines 14A, 14B, the power line receiver 24 is able to detect the control signal 20 even if it is relatively weak. The connection of the resonant circuit 38 across the AC power lines 14A, 14B provides the power line receiver 24 with a detector with a high Q factor. This high Q factor allows the resonant circuit 38 to resonate with high amplitude near the resonant frequency 38B. Consequently, the resonant circuit 38 may be configured to have a resonant frequency 38B as close as possible to the center frequency 34A of the control signal 20. Theoretically, the resonant frequency 38B is chosen to be equal to the center frequency 34A of the ballast control signal 20. This parallel-coupled resonant circuit 38 provides for high noise immunity and permits the signal level of the control signal 20 to be relatively low.

Figure 2:
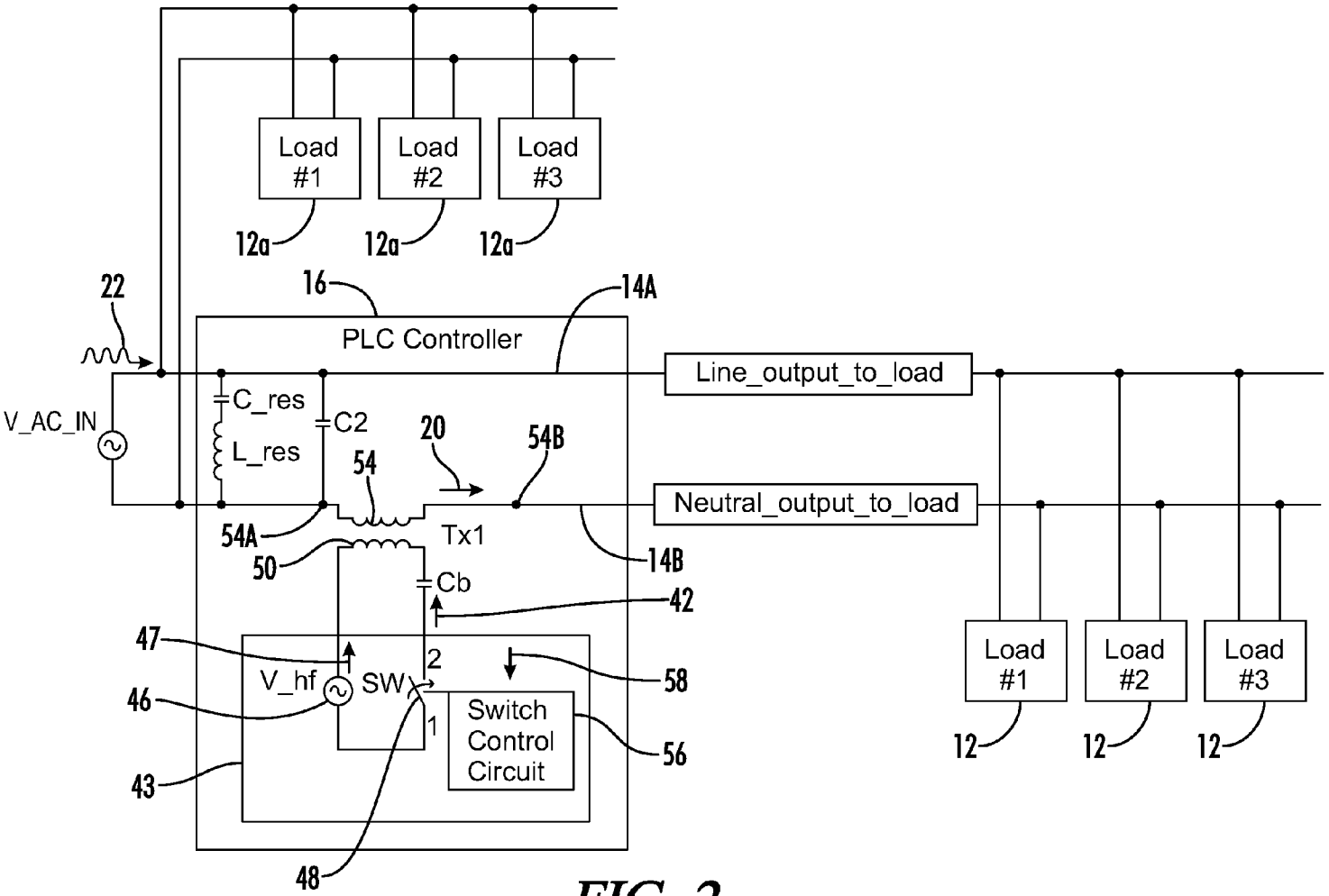
FIG. 2 is a circuit diagram of one embodiment of the power line controller as disclosed herein.
Figure 3:
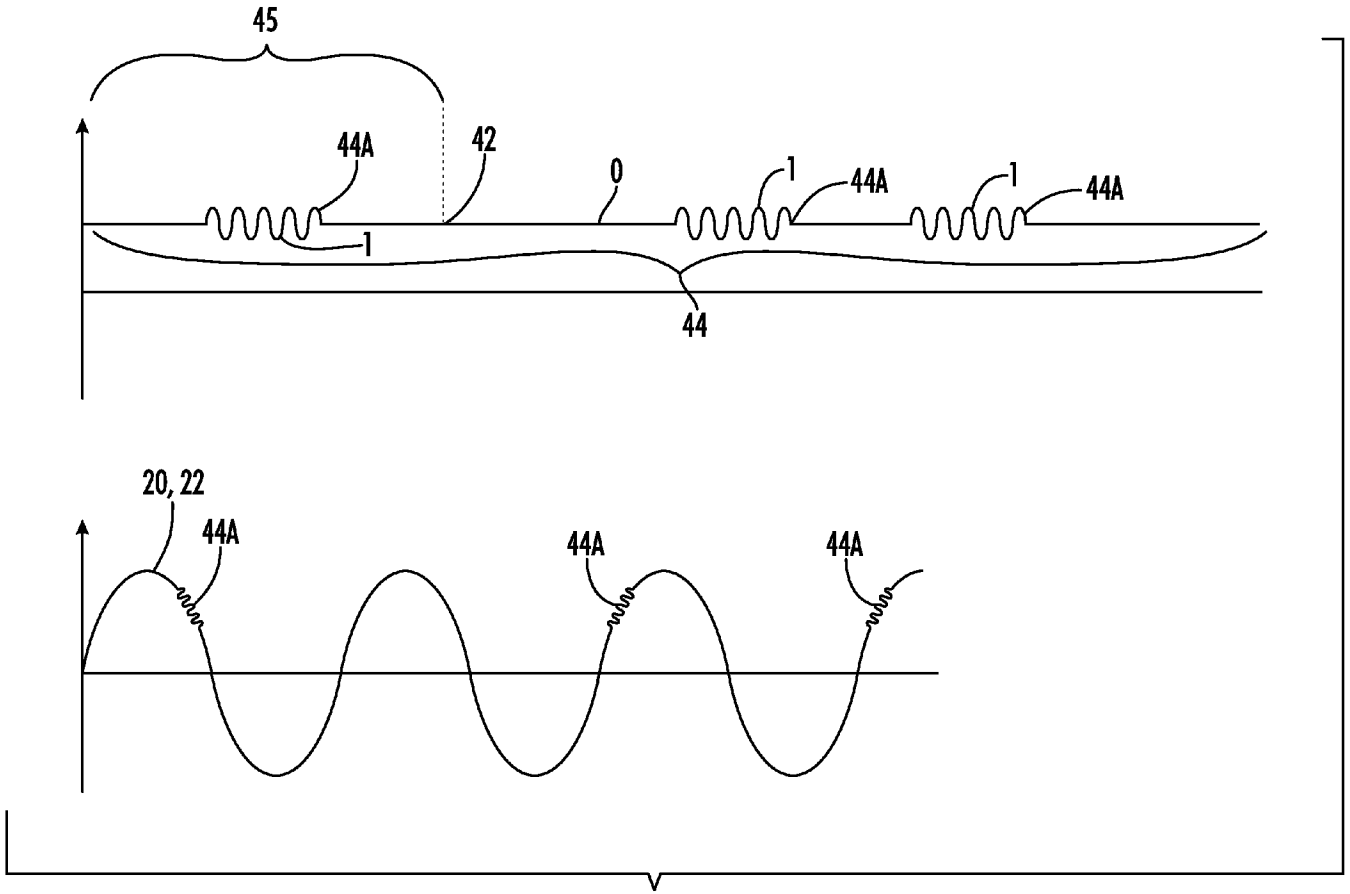
FIG. 3 is an illustration of two graphs related to signals created by the power line controller shown in FIG. 2. The top graph in FIG. 3 is a time domain illustration of the dimming level information signal generated by a switch pattern circuit of the power line controller. The bottom graph in FIG. 3 is a time domain illustration of an AC power signal for powering a lighting circuit after the power line controller has inserted a control signal on the AC power signal.

Referring now to FIG. 2 and FIG. 3, the operation of one embodiment of the power line controller 16 is described. In the example shown, a power line controller 16 is positioned between an AC input V_AC_IN and a first set of one or more loads 12, whereas the same AC input may further be provided to one or more additional loads or sets of loads 12*a*, for which additional power line controllers (not shown) may be provided. Power line controller 16 has a signal pattern circuit 43 that produces a dimming level information signal 42 with a signal pattern 44 (FIG. 3) that is utilized to communicate the desired dimming level. As mentioned above, codes may be utilized to transmit information on the AC power signal 22. The signal pattern 44 of the dimming level information signal 42 may be generated in accordance with one of these codes.

For example, the embodiment of the power line controller 16 illustrated in FIG. 2 has a signal pattern circuit 43 that generates the dimming level information signal 42 in accordance with a digital high frequency injection scheme. The signal pattern 44 of the digital high frequency injection scheme is a series of high frequency pulses 44A that represent a series of bits. To illustrate, the presence of a high frequency pulse 44A during a particular time interval 45 of the dimming level information signal 42 may represent a "one" while the absence of a high frequency pulse 44A during a particular time interval may represent a "zero". This series of bits represents the desired dimming level.

To generate the series of high frequency pulses 44A, the signal pattern circuit 43 has a high frequency signal production circuit 46 that generates a high frequency signal 47. The frequency of the high frequency signal 47 should be higher than the frequency of the AC power signal 22. In the illustrated embodiment, the AC power signal 22 operates at 50 Hz to 60 Hz while the frequency of the high frequency signal 47 is greater than 154 kHz.

A primary winding 50 of transformer TX_1 is coupled to the signal pattern circuit 43. Output terminals 54A, 54B of the power line controller 16 should be configured to connect the secondary winding 54 in series with AC power line 14B. High frequency pulses 44A are created by opening and closing the switch 48 which is coupled to the high frequency signal production circuit 46 and the transformer TX_1. Transformer, TX_1, may isolate signal pattern circuit 43 from the AC power signal 22 to protect the circuit. Switch 48 couples the high frequency signal 47 to the transformer TX_1 when the switch 48 is closed and suspends the transmission of the high frequency signal 47 to the transformer TX_1 when the switch 48 is open. By timing the opening and closing of switch 48, the signal pattern 44 of the dimming level information signal 42 represents the desired dimming level through the series of high frequency pulses 44A.

The control signal 20 is inserted on the AC power signal 22 and is associated with the dimming level information signal 42. The control signal 20 may be the dimming level information signal 42. The power line receivers and AC power systems may be designed to be robust enough to receive and process a dimming control signal 20 as simply being itself the dimming level information signal 42. However, dimming level information signal 42 may have characteristics that are disadvantageous for transmission over the AC power lines 14A, 14B. If so, certain components may be included so that the power line controller 16 inserts a suitable control signal 20 on the AC power signal 22.

For example, a high frequency signal bypass filter may be connected between the AC power lines 14A, 14B to prevent high frequency components in the control signal 20 from being reflected on the AC power lines, 14A, 14B. In one embodiment, a series resonant circuit is formed of components C_res and L_res and connected in parallel with filtering capacitor C2. The resonant frequency of this resonant filter may be designed at the control signal frequency so that the impedance of this resonant filter at the signal frequency is close to zero, or in other words the components for the resonant circuit may be selected in view of the signal frequency f_ctl that the power line controller is transmitting according to the equation:

$$f_{ctl} = \frac{1}{2 \cdot \pi \cdot \sqrt{L_{res} \cdot C_{res}}}.$$

In this manner the control signal will be bypassed or shorted before it reaches the power supply V_AC_IN. This approach may effectively prevent high frequency components in the control signal 20 from being reflected on the AC power lines, 14A, 14B.

A DC filter may further be coupled between the signal pattern circuit 43 and the transformer Tx_1 to filter out DC signal components from the dimming level information signal 42. This prevents DC signal components from being transmitted over the AC power lines 14A, 14B. Transformer Tx_1 may also affect the characteristics of the dimming level information signal 42, such as the voltage and current amplitudes of the control signal 20. The power line controller 16 may also have additional equipment for manipulating the timing, frequency characteristics, or shape of the signal pattern 44 on the control signal 20 in accordance with the particular characteristics required by the power line receiver.

Secondary winding 54 of transformer Tx_1 may connect in series with AC power line 14B to insert the control signal 20 on the AC power signal 22. However, power line controller 16 may connect to either AC power line 14A, 14B to insert the control signal 20 on the AC power signal 22. The series connection of secondary winding 24 allows the power line controller 16 to insert what may be a relatively weak control signal 20 on AC power signal 22.

In the illustrated embodiment, switch control circuit 56 in the signal pattern circuit 43 opens and closes the switch 48 to generate the signal pattern 44. This switch control circuit 56 receives a dimming level input signal 58 to determine the desired dimming ballast level which is to be communicated over the AC power lines 14A, 14B. Dimming level input signal 58 may be a digital signal that represents the desired dimming level or may be an analog signal such as a DC signal whose DC level represents the desired dimming level.

In either case, switch control circuit 56 translates this information into the appropriate signal pattern 44, for transmitting the desired dimming level and opens and closes the switch 48 accordingly. Switch control circuit 56 may thus store or receive information about dimming level codes to produce the appropriate dimming level information signal 42. In addition, if the dimming level input signal 58 is a digital signal then the switch control circuit 56 may simply cause the switch 48 to open and close and create a signal pattern 44 of ones and zeros in accordance with the "ones" and "zeros" of the digital signal.

In contrast, if the power line receiver is not equipped to translate the digital format of the dimming level input signal 58, the switch control circuit 56 may translate the dimming level input signal into the appropriate digital format for the desired dimming level and generate a signal pattern 44 in accordance with this format.

If the dimming level input signal 58 is an analog signal, then the switch control circuit 56 may associate the signal level of the dimming level input signal 58 with the desired dimming level and open and close the switch 48 accordingly. Once the control signal 20 has been inserted on the AC power signal 22, the AC power signal 22 is transmitted over the AC power lines 14A, 14B to power one or more load or lighting circuits 12. The illustrated embodiment generates a control signal 20 having the series of high frequency pulses 44A in the dimming level information signal 42. The AC power signal 22 is shown in the bottom graph in FIG. 1A after having been inserted with control signal 20. High frequency pulses 44A have been inserted on the AC power signal 22 for communication to a power line receiver.

Figure 4:
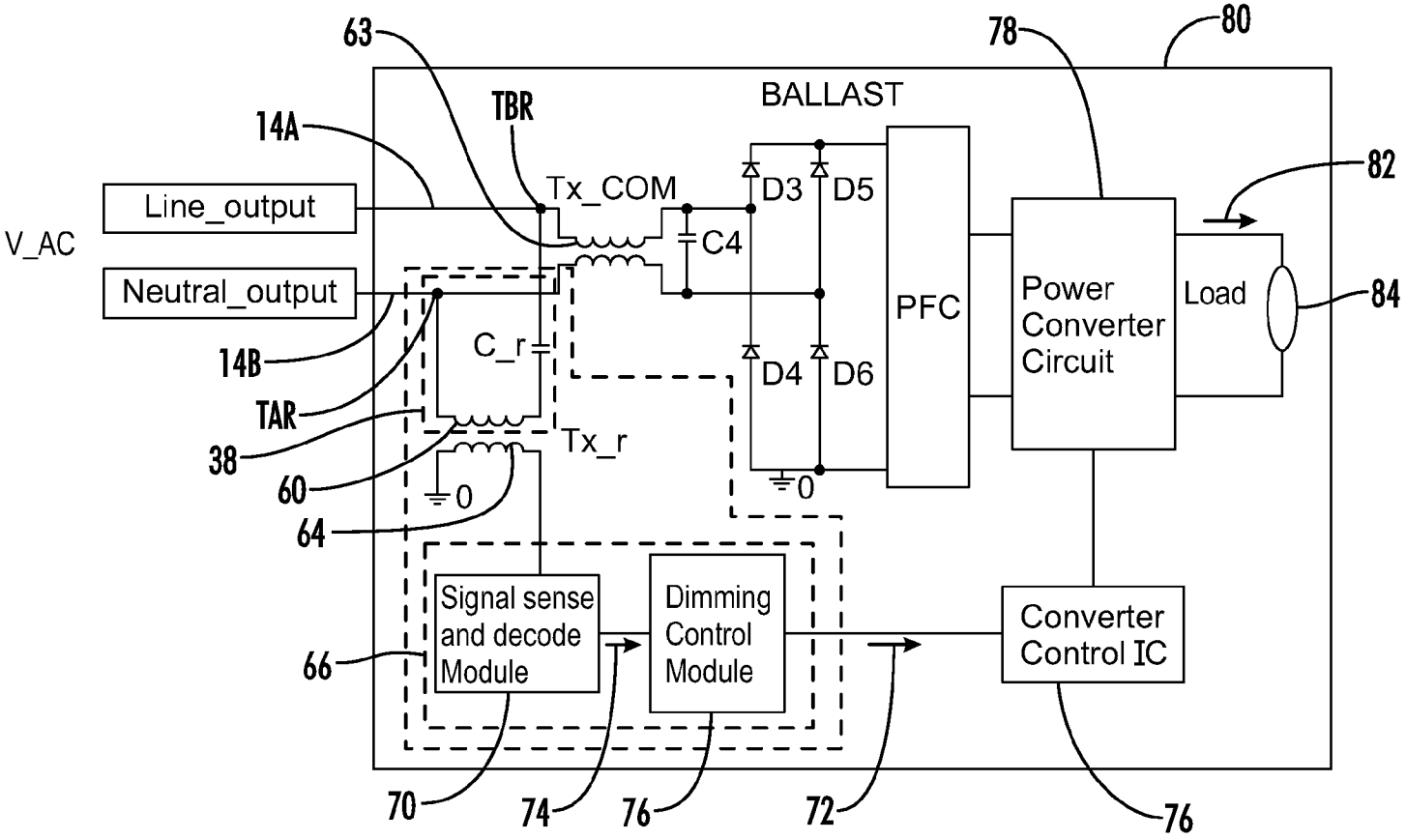
FIG. 4 is a circuit diagram of one embodiment of the power line receiver coupled to a lighting circuit.
Figure 4A:
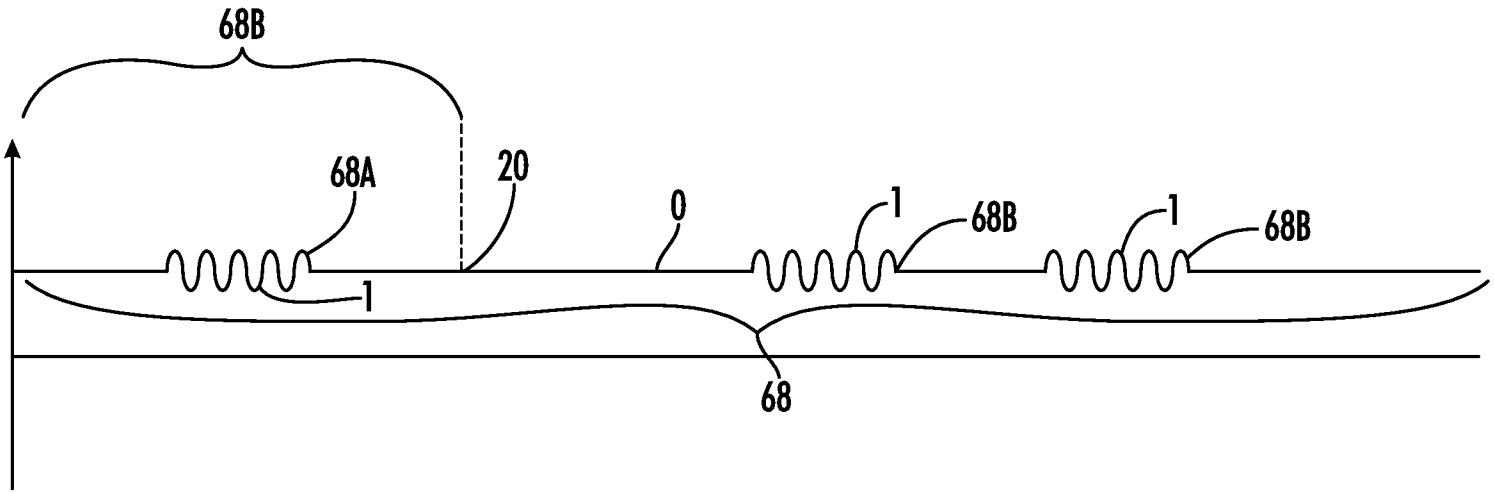
FIG. 4A is a time domain illustration of the control signal after it has been extracted from the AC power signal by the power line receiver shown in FIG. 4.

Referring now to FIG. 1A, FIG. 4, and FIG. 4A, the operation of one embodiment of the power line receiver 24 that receives AC power signal 22 with control signal 20 is shown and described. The power line receiver 24 shown in FIG. 4 is integrated into the lighting circuit 80. Input terminals TAR, TBR are configured so that when the power line receiver 24 is connected to AC power line 14B, resonant circuit 38 is connected in parallel with the AC power lines 14A, 14B. Resonant circuit 38 of the power line receiver 24 is shown as a series resonant circuit having capacitor C_r and the primary winding 60 of transformer Tx_r. This resonant circuit 38 should be connected to the AC power line 14B in front of the electromagnetic interference filter 63 in the lighting circuit 80 to avoid distortion of the control signal 20. Transformer Tx_r thus acts to isolate the power line receiver 24 from the power line 14B and also is part of a resonant circuit 38 for receiving the ballast control signal 20.

The resonant frequency of the resonant circuit 38 may preferably be designed at the control signal frequency f_ctl to provide great selectivity and gain:

$$f_{ctl} = \frac{1}{2 \cdot \pi \cdot \sqrt{TX_r \cdot C_r}}$$

Furthermore, this series resonant circuit improves noise immunity by being connected in parallel with the AC main, as the noisy input current going into the ballast or driver does not pass through the signal receiver circuit. This may provide the additional benefit of minimizing the size of the transformer Tx, which otherwise may have to account for such a large input current.

As explained above, resonant circuit 38 extracts the control signal 20 from the AC power signal 22 and transmits the control signal 20 to secondary winding 64 of transformer TX_r which is connected to a dimming level sensing circuit 66. As illustrated in FIG. 2, the bandwidth 34 of the control signal 20 is within the bandwidth 40 for the response curve 38A of the resonant circuit 38.

The dimming level sensing circuit 66 senses the signal pattern 68 on the control signal 20 and generates a dimming level signal 72 corresponding to the desired dimming level. In the illustrated embodiment, signal pattern 68 is formatted according to a high frequency digital communication code. Each "one" or "zero" is represented by the presence or absence of a high frequency pulse 68A during a time interval 68B of the control signal 20. Dimming level sensing circuit 66 receives the control signal 20 at signal pattern decoder circuit 70 which is operable to convert the signal pattern 68 into a digital signal 74 representing the desired dimming level. Signal pattern decoder circuit 70 is thus equipped with an analog-to-digital converter capable of sensing a high frequency pulse 68A and creating a digital signal 74 in accordance with the transmitted signal pattern 68 of the control signal 20. Dimming signal production circuit 76 receives digital signal 74 and is operable to generate the dimming level signal 72 corresponding to the desired dimming level based on the digital signal 74.

Dimming level signal 72 may then be transmitted to a control circuit 76 that controls the switch frequency of a power converter 78 for the lighting circuit 80. In this embodiment, dimming level signal 72 is a DC signal having a signal level corresponding to the desired dimming level. Inverter control circuit 76 utilizes the dimming level signal 72 as a reference signal and compares the reference signal with a signal from the power converter 78 or lighting device. A switch frequency of the power converter 78 is adjusted to produce an output signal 82 to the lighting device in accordance with this comparison. The power consumed by lighting device 84 is thus adjusted in accordance with the dimming level signal 72. Dimming signal production circuit 76 may thus be configured with a digital-to-analog converter that receives the digital signal 74 and converts that digital signal 74 into the dimming level signal 72.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

The terms "switching element" and "switch" may be used interchangeably and may refer herein to at least: a variety of transistors as known in the art (including but not limited to FET, BJT, IGBT, IGFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A power line communication system for communicating a dimming level to an electronic ballast or LED driver as a lighting circuit, the system comprising:

first and second AC power lines for transmitting an AC power signal to the lighting circuit;

a power line controller configured to generate a control signal having a signal pattern associated with a desired dimming level and being coupled to one or more of the AC power lines to insert the control signal on the AC power signal;

a first resonant circuit coupled across the AC power lines and having a resonant frequency equivalent to a frequency of the control signal from the power line controller; and a power line receiver configured to receive the AC power signal with the control signal, including a second resonant circuit connected in parallel with the AC power lines and operable to extract the control signal from the AC power signal, and a dimming level sensing circuit coupled to the second resonant circuit and configured to sense the signal pattern of the control signal and generate a dimming level signal corresponding to the desired dimming level.

2. The power line communication system of claim 1, further comprising:

an electromagnetic interference filter for the lighting circuit coupled to the AC power lines; and the second resonant circuit being connected across the AC power lines between the power line controller and the electromagnetic interference filter.

3. The power line communication system of claim 2, wherein the second resonant circuit comprises a resonant frequency equivalent to the frequency of the control signal.

4. The power line communication system of claim 1, wherein the power line controller further comprises a transformer having a secondary winding connected in series with one of the AC power lines, and between the first resonant circuit and the power line receiver.

5. The power line communication system of claim 4, further comprising:

the transformer having a primary winding; and a signal pattern circuit coupled to the primary winding, the signal pattern circuit operable to produce a dimming level information signal associated with the control signal in accordance with a communication protocol.

6. A power line controller for controlling a dimming level of an electronic ballast or an LED driver as a lighting circuit connected to receive an AC power signal from an AC power line, comprising:

a transformer having a transformer coil connected in series with the AC power line;

a signal pattern circuit further comprising a high frequency signal production circuit that generates a high frequency signal, and a switch coupled between the high frequency signal production circuit and the transformer so that the switch transmits the high frequency signal to the transformer when the switch is closed and suspends the transmission of the high frequency signal to the transformer when the switch is open, wherein a control signal having a signal pattern comprising a series of high frequency pulses associated with a desired dimming level is inserted on the AC power signal via the transformer coil; and a series resonant circuit coupled in parallel with the AC power line, the series resonant circuit having a resonant frequency equivalent to a frequency of the control signal.

7. The power line controller of claim 6, wherein the signal pattern is associated with a dimming level communication code.

8. The power line controller of claim 6, wherein the signal pattern of the dimming level information signal comprises a series of high frequency pulses.

9. The power line controller of claim 6, wherein the signal pattern represents a digital code for communicating the desired dimming level to the lighting circuit.

10. The power line controller of claim 6, further comprising a DC filter coupled between the signal pattern circuit and the transformer, the DC filter configured to filter out DC signal components from the dimming level information signal.

11. The power line controller of claim 6, wherein the high frequency signal has a frequency greater than a frequency of the AC power signal.

12. The power line controller of claim 6, wherein the signal pattern circuit further comprises a switch control circuit coupled to the switch and having an input terminal for receiving a dimming level input signal related to the desired dimming level, the switch control circuit being responsive to the dimming level input signal to open and close the switch so that the signal pattern circuit creates the series of high frequency pulses.

13. The power line controller of claim 6, wherein the switch control circuit is configured to open and close the switch so that the signal pattern of the dimming level information signal represents the desired dimming level in accordance with a dimming level communication code.

14. The power line controller of claim 6, further comprising the transformer having a second transformer coil coupled between the first transformer coil and the signal pattern circuit.

15. A power line receiver for determining a dimming level of an electronic ballast or LED driver as a lighting circuit connected to receive an AC power signal from an AC power line, comprising:

a resonant circuit configured to detect a control signal transmitted on the AC power signal, the control signal having a signal pattern associated with a desired dimming level;

first and second input terminals configured to connect the resonant circuit in parallel with the AC power line; and a dimming level sensing circuit coupled to the resonant circuit, the dimming level sensing circuit configured to sense the signal pattern of the control signal and generate a dimming level signal corresponding to the desired dimming level.

16. The power line receiver of claim 15, further comprising:

a transformer having a primary winding for receiving the control signal; and the resonant circuit including the primary winding of the transformer.

17. The power line receiver of claim 16, wherein the transformer further comprises a secondary winding coupled between the primary winding and the dimming level sensing circuit.

18. The power line receiver of claim 17, wherein the resonant circuit includes a capacitor in series with the primary winding of the transformer, and the resonant circuit comprises a resonant frequency equivalent to a frequency of the control signal.

19. The power line receiver of claim 18, wherein the dimming level sensing circuit further comprises a signal pattern decoder circuit operable to convert the signal pattern into a digital signal representing the desired dimming level.

20. The power line receiver of claim 19, wherein the dimming level sensing circuit further comprises a dimming signal production circuit coupled to the signal pattern decoder circuit, the dimming signal production circuit being operable to generate the dimming level signal corresponding to the desired dimming level based on the digital signal.

* * * * *